US006207885B1

(12) United States Patent
Nogami et al.

(10) Patent No.: US 6,207,885 B1
(45) Date of Patent: Mar. 27, 2001

(54) SYSTEM AND METHOD FOR RENDITION CONTROL

(75) Inventors: Kenji Nogami, Hamamatsu; Kouji Ooe, Shizuoka-ken; Hiroshi Ishizaki, Hamamatsu; Shigeru Yoshida, Shizuoka, all of (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/484,519

(22) Filed: Jan. 18, 2000

(30) Foreign Application Priority Data

Jan. 19, 1999 (JP) ..... 11-010028
Mar. 3, 1999 (JP) ..... 11-055909

(51) Int. Cl.[7] ..... G10H 7/00
(52) U.S. Cl. ..... 84/636; 84/605; 84/626
(58) Field of Search ..... 84/605, 612, 624, 84/629, 636, 652; 704/503

(56) References Cited

U.S. PATENT DOCUMENTS 5,350,882 * 9/1994 Koguchi et al. ..... 84/612 X
5,511,053 * 4/1996 Jae-Chang ..... 84/612 X
5,952,596 * 9/1999 Kondo ..... 84/605
5,973,255 * 10/1999 Tanji ..... 84/604 X

* cited by examiner

*Primary Examiner*—Jeffrey Donels
(74) *Attorney, Agent, or Firm*—Foley & Lardner

(57) ABSTRACT

The invention presents a rendition control apparatus that not only reduces processing so that processing is neither complicated nor complex, but also reduces the used storage region. The rendition control apparatus allows for differences in the timing over the passage of time when reproducing and rendering a continuous sound waveform, and renders sound waveforms naturally and with good rhythm, while making it possible to change the reproduction tempo freely. The rendition control apparatus includes a waveform data storage means for storing waveform data rendered at a certain tempo; a reproduction tempo information production means for producing reproduction tempo information indicating a reproduction tempo; a time-axis compression/expansion processing means for compressing/expanding and reproducing the waveform data stored in said waveform data storage means in real-time on the time axis, based on reproduction tempo information produced by said reproduction tempo information production means; a control signal production means for producing a control signal for modulating periodically with the passage of time the reproduction with the time-axis compression/expansion processing means, based on the reproduction tempo information. Reproduction tempo information produced by said reproduction tempo information production means are entered into said control signal production means, and said control signal production means produces, as the control signal, a periodical signal whose period corresponds to the entered reproduction tempo information.

23 Claims, 14 Drawing Sheets

SYSTEM AND METHOD FOR RENDITION CONTROL

RELATED APPLICATIONS

This application claims priority to Japanese patent applications 11-10028 filed on Jan. 19, 1999, and 11-55909 filed on Mar. 3, 1999.

BACKGROUND OF THE INVENTION

1. Field of the Invention

The present invention relates to a rendition control apparatus, which controls a rendition by compressing or expanding the time axis of waveform data (time stretching) to generate a reproduction waveform.

2. Description of the Related Art

Conventionally, in the field of electronic instruments, e.g., samplers are used, which sample the actually rendered phrase into waveform data without changing it, to reproduce a group of continuous tones, such as a complete melody or a part thereof (in the following, "a group of continuous tones, such as a complete melody or a part thereof" is also called "a phrase") with an electronic instrument,.

In Japanese Patent Application (Tokugan) Nr. H10-205482 with the title "Apparatus for Controlling the Rendition of Waveform Data" (application date: Jul. 21, 1998), the applicant to the present application has presented a technique for imparting effects, such as swinging, on waveform data by compressing or expanding the waveform data on the time axis, in which a sampler is used that samples a phrase into waveform data without changing it.

The technique disclosed in Japanese Patent Application Nr. H10-205482 pre-stores, for each set of waveform data, control signals for imparting effects, such as swinging, on the waveform data (referred to simply as "control signals" in the following), the control signals being optimized for the corresponding waveform data. With these control signals, the rendition control apparatus compresses or expands the waveform data on the time axis and reproduces the waveform data.

Because the technique disclosed in this Japanese Patent Application Nr. H10-205482 includes storing a control signal for each set of waveform data, the control signals are characterized by a precise synchronization with the phrase, regardless of fluctuations in the tempo of the sampled phrase.

Other conventional rendition control apparatuses that are known in the related art control renditions by pre-storing a continuous sound waveform and compressing or expanding the stored sound waveform on the time axis to generate a reproduction waveform. One such rendition control apparatus is disclosed in Japanese Patent Application Nr. H10-55180, which proposes a technique for controlling a swing rendition. With this technique, a sound waveform is prestored, and expansion and compression on the time axis are performed by reading out the former half of the waveform within periods, into which the stored sound waveform has been segmented periodically depending on note length, at a relatively slower speed, and the latter half at a relatively faster speed, whereby a swing is imparted on the reproduced musical sound. The publication explains that a plurality of variation patterns of the read-out speed necessary for reading out the waveform are arranged, a pattern is selected from this plurality of patterns, and always applied to the same phrase, whereby several different rhythms can be achieved.

It is further mentioned that during the reproduction of the sound waveform, the user can switch between those variation patterns of read-out speed to achieve several different rhythms. Here, a continuous sound waveform or phrase means a rhythm or a melody based on a string of a plurality of tones, wherein one or more bars of rhythm or melody are usually regarded as one phrase.

Because the technique disclosed in the aforementioned Japanese Patent Application Nr. H10-205482 stores a control signal for each set of waveform data, a large storage region is necessary for storing these control signals.

Also, for a simultaneous sound production with a plurality of waveform data simultaneously using the technique disclosed in this Japanese Patent Application Nr. H10-205482, it is necessary to produce the same number of control signals as there are sets of waveform data for the sound production, which makes the processing complicated. In other words, because in the technique disclosed in this Japanese Patent Application Nr. H10-205482, the processes for multiple simultaneous sound production is complex and complicated, and the processes for the compression and expansion of the control signal are also complex and complicated, the load on the digital signal processor (DSP) becomes too large if these processes are performed by a DSP.

Moreover, when a phrase is rendered on an actual instrument, the timing of the rendition often differs slightly with each beat, and even when the same phrase is repeated, there are usually slight differences of timing for each rendition, and to reproduce a sound waveform with a swing rendition it would be preferable to provide a function allowing for such a rendition, as this would enable a natural rendition. But with the technique disclosed in the aforementioned Japanese Patent Application Nr. H10-55180, it is only possible to apply a selected pattern uniformly to a complete phrase, or the user can simply select a variation pattern manually. In these publications, there is no suggestion of providing the rendition with slight differences in the timing over the passage of time as described above, when applying a swing to a musical sound. Moreover, there is no suggestion of changing the reproduction tempo of the sound waveform when applying these slight timing differences.

SUMMARY OF THE INVENTION

With the foregoing in mind, it is an object of the present invention to provide a rendition control apparatus, wherein the processing is simplified, so that the processing is neither complex nor complicated, while reducing the storage area used. It is a further object of the present invention to provide a rendition control apparatus that allows for differences in the timing over the passage of time when reproducing and rendering a continuous sound waveform, and renders sound waveforms naturally and with good rhythm, while making it possible to change the reproduction tempo freely.

A first and a second rendition control apparatus in accordance with the present invention have been conceived after noticing that in practice there is almost no problem whatsoever if a control signal for adding an effect to a set of waveform data does not precisely match the period of the waveform data. In these rendition control apparatuses, which compress/expand and reproduce waveform data on the time axis, compressing and expanding on the time axis in accordance with reproduction tempo information that is synchronized with the reproduction tempo makes is possible to perform the reproduction while changing a certain timing without changing the entire reproduction tempo, as in a swing reproduction with an automatic rhythm instrument.

A rendition control apparatus in accordance with a first aspect of the present invention includes:

a waveform data storage means for storing waveform data rendered at a certain tempo;

a reproduction tempo information production means for producing reproduction tempo information indicating a reproduction tempo;

a time-axis compression/expansion processing means for compressing/expanding and reproducing the waveform data stored in the waveform data storage means in real-time on the time axis, based on reproduction tempo information produced by the reproduction tempo information production means;

a control signal production means for producing a control signal for modulating periodically with the passage of time the reproduction with the time-axis compression/expansion processing means, based on the reproduction tempo information;

wherein reproduction tempo information produced by the reproduction tempo information production means are entered into the control signal production means, and the control signal production means produces, as the control signal, a periodical signal whose period corresponds to the entered reproduction tempo information.

Thus, the rendition control apparatus of the first aspect of the invention includes a control signal production means for producing a control signal for modulating the reproduction periodically with the passage of time, based on the reproduction tempo information, and the control signal production means produces, as the control signal, a periodical signal whose period corresponds to the entered reproduction tempo information, which facilitates the processing, as there is no need to perform compression or expansion processing of the control signal to match the reproduction tempo, and when a DSP is used for the processing, the load of the DSP can be alleviated.

Moreover, in the rendition control apparatus of the first aspect of the invention, the control signal is produced by the control signal production means, so that there is no need for a large storage area for storing control signals, and the storage area used can be reduced.

A rendition control apparatus in accordance with a second aspect of the present invention includes:

a waveform data storage means for storing a plurality of sets of waveform data rendered at a certain tempo;

a reproduction tempo information production means for producing reproduction tempo information indicating a reproduction tempo;

a control signal production means for producing a control signal for modulating periodically with the passage of time reproduction tempo information produced by the reproduction tempo information production means;

a plurality of time-axis compression/expansion processing means for compressing/expanding and reproducing the plurality of sets of waveform data stored in the waveform data storage means in real-time on the time axis, based on reproduction tempo information produced by the reproduction tempo information production means and a control signal produced by the control signal production means;

wherein reproduction tempo information produced by the reproduction tempo information production means is entered into the control signal production means, and the control signal production means produces, as the control signal, a periodical signal whose period corresponds to the entered reproduction tempo information.

Thus, the rendition control apparatus of the second aspect of the invention includes a control signal production means for producing a control signal for modulating reproduction tempo information periodically with the passage of time, and the control signal production means produces, as the control signal, a periodical signal whose period corresponds to the entered reproduction tempo information, so that the processing can be facilitated, as there is no need to perform compression or expansion processing of the control signal to match the reproduction tempo, and when a DSP is used for the processing, the load of the DSP can be alleviated.

Moreover, when a plurality of sets of waveform data are sound-produced simultaneously using the second aspect of the present invention, it is sufficient to produce only one control signal, and there is no need to produce the same number of control signals as there are sets of waveform data to be sound-produced, which reduces the processing and alleviates the load of the DSP when a DSP is used for the processing.

Furthermore, in the rendition control apparatus of the second aspect of the invention, the control signal is produced by the control signal production means, so that there is no need for a large storage area for storing control signals, and the storage area used can be reduced.

A rendition control apparatus in accordance with a third aspect of the present invention includes:

a waveform data storage means for storing a continuous sound waveform;

a compression/expansion means for generating a reproduction waveform by compressing or expanding the sound waveform while following the change of a control signal, which indicates a level of compression or expansion, and whose temporal changes are tolerated; and a periodic signal generation means for generating a periodic signal whose waveform shape changes with the passage of time, and transferring this periodic signal to the compression/expansion means as the control signal.

In the rendition control apparatus of the third aspect of the invention, the periodic signal generation means generates a periodic signal whose waveform shape changes with the passage of time, this periodic signal is transferred to the compression/expansion means as the control signal, and the compression/expansion means compresses or expands the sound waveform stored in the waveform storage means while following the change of the control signal, generating a reproduction waveform. Thus, when, e.g., in a swing rendition of one certain phrase, phrase portions with strong stress (i.e., down beats) are rendered, a periodic signal whose waveform is adapted to the down beats is taken as the control signal, and when phrase portions with weak stress (i.e., up beats) are rendered, a periodic signal whose waveform is adapted to the up beats is taken as the control signal to generate the production waveform, so that the timing changes in accordance with the beats and the rendition differentiates between down beats and up beats. Consequently, a rendition with good rhythm becomes possible.

It is preferable that the rendition control apparatus of the third aspect of the invention further includes a reproduction tempo setting means for setting a tempo of the reproduction waveform in the compression/expansion means;

the compression/expansion means generating a reproduction signal having a tempo set with the reproduction tempo setting means;

and the periodic signal generation means generating a periodic signal whose period corresponds to the tempo set with the reproduction tempo setting means.

With this configuration, it is possible not only to set the tempo of the rendition to a desired tempo with the reproduction tempo setting means, but also to compress or expand the sound waveform in accordance with the tempo that has been set.

It is preferable that the periodic signal generation means of the rendition control apparatus of the third aspect of the invention includes

- a periodic waveform storage means for storing a plurality of periodic waveforms;
- a periodic waveform read-out means for temporally switching, in accordance with certain sequence information, between a plurality of periodic waveforms stored in the periodic waveform storage means, so as to generate a periodic signal whose waveform shape changes with the passage of time; and
- a sequence information storage means for storing sequence information specifying an order with which the periodic waveforms are read out by the periodic waveform read-out means.

With this configuration, for a swing rendition of a continuous musical sound, for example, a precise swing variation of the continuous musical sound can be achieved with a predetermined order and smooth texture.

As has been explained above, the present invention not only simplifies processing so that it is neither complex nor complicated, but also reduces the storage area used. Moreover, it achieves a rendition with good rhythm.

BRIEF DESCRIPTION OF THE DRAWINGS

FIG. 5(*b*) shows how the timing of the musical sound changes depending on the beat information.

DETAILED DESCRIPTION OF THE PREFERRED EMBODIMENTS

First Embodiment

Figure 1:
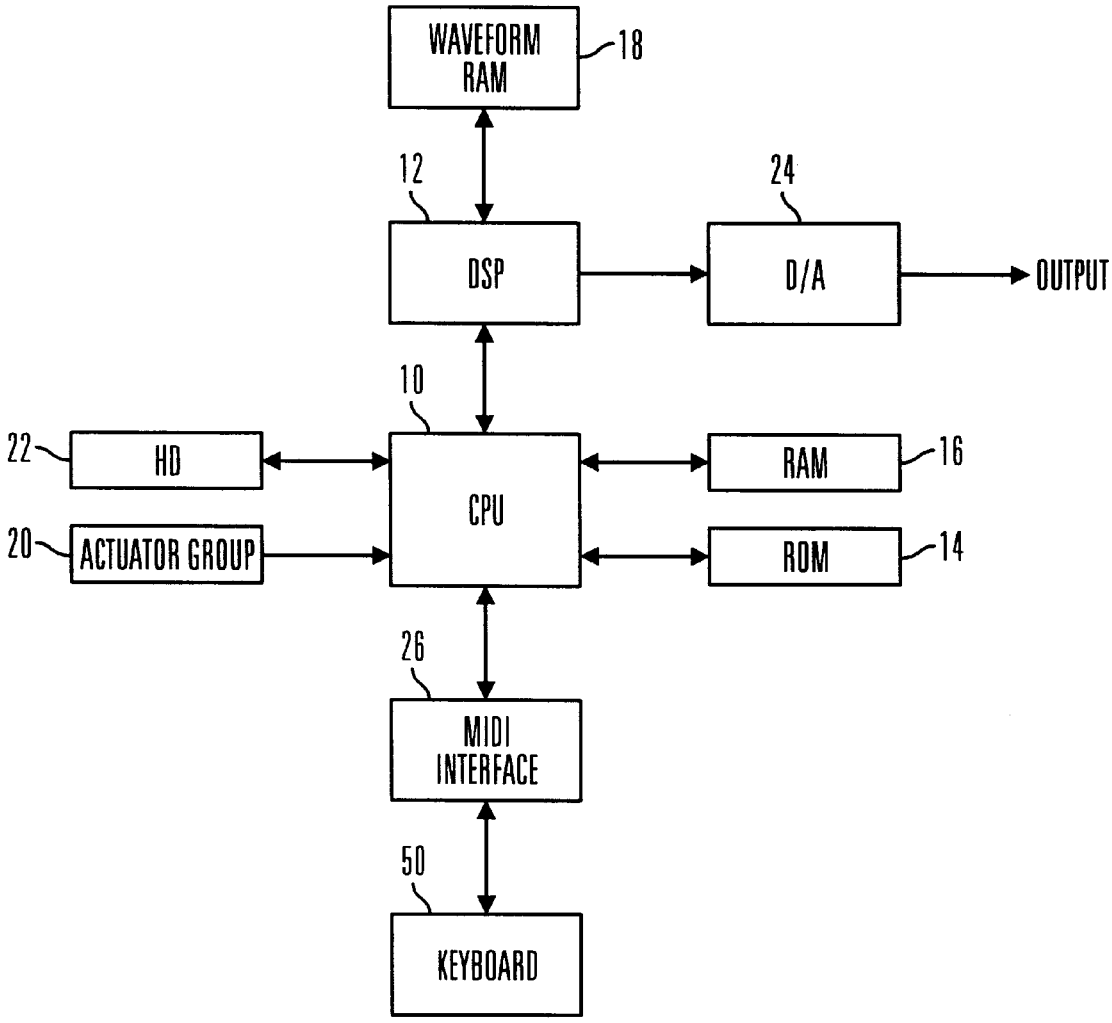
FIG. 1 is a block diagram showing a first embodiment of the rendition control apparatus of the present invention laid out as a hardware configuration.

The following is a description of a rendition control apparatus in accordance with a first embodiment of the present invention, with reference to the accompanying drawings.

In the following explanations, it is assumed that the waveform data storage means 100, the waveform generation means 102, the reproduction tempo information production means 104, the control signal production means 106, and the adding means 108, which are part of the rendition control apparatus of the first embodiment, are realized as software with the waveform RAM 18 and the DSP 12 explained below.

FIG. 1 is a block diagram schematically showing a first embodiment of the rendition control apparatus of the present invention laid out as a hardware configuration. This rendition control apparatus includes a central processing unit (CPU) 10 for controlling its entire operation, a DSP 12 constituting a processing means for the rendition control processing of waveform data as shown in the block diagram of FIG. 2, a read-only memory (ROM) 14 storing, for example, a program which the CPU 10 executes to control the entire operation, and a program which the DSP 12 executes to control the rendition, a random access memory (RAM) 16 providing space for storing registers and flags, and used as a working memory for processing performed by the CPU 10, a waveform RAM 18 serving as a waveform data storage means to which waveform data are transferred and stored, which have been selected from a plurality of waveform data sets stored in a hard disk recorder (HD) 22 explained below, by operating an HD waveform data selection/transfer actuator, which is part of a actuator group 20 explained below, a actuator group 20 including a actuator for beginning a sound production, a actuator for setting the reproduction tempo, an HD waveform data selection/transfer actuator for selecting the desired set of waveform data from a plurality of waveform data sets stored on the hard disk (HD) 22 and transferring the selected set of waveform data to the waveform RAM 18, a waveform RAM waveform data transfer actuator for transferring waveform data stored in the waveform RAM 18 to the HD 22, an HD 22 serving as a mass-capacity storage device for storing a plurality of sets of waveform data, a digital/analog converter (D/A) 24 for converting digital waveform signals generated in the DSP 12 into analog waveform signals, and a MIDI interface 26 serving as an interface for inputting/outputting MIDI signals from/to, e.g., an external keyboard 50.

In accordance with the program stored in the ROM 14, the CPU 10 executes a procedure for controlling the DSP 12, a procedure for operating and detecting the actuators that make up the actuator group 20, a transfer procedure for transferring waveform data stored in the HD 22 to the waveform RAM 18 through the DSP 12, or a MIDI signal input/output procedure for inputting/outputting MIDI signals from/to, e.g., an external keyboard 50 through a MIDI interface 26.

Figure 2:
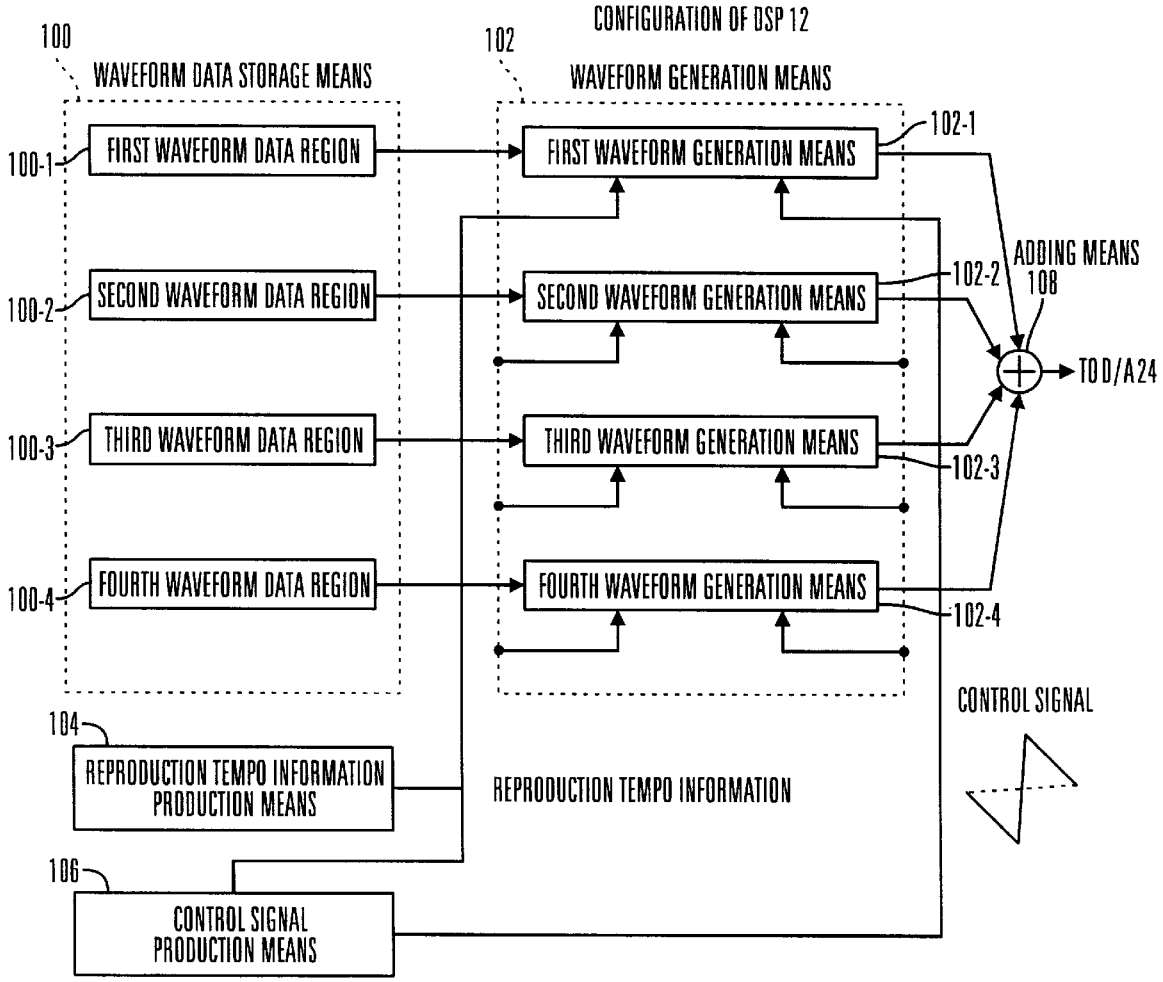
FIG. 2 is a block diagram showing the configuration of the DSP.
Figure 3:
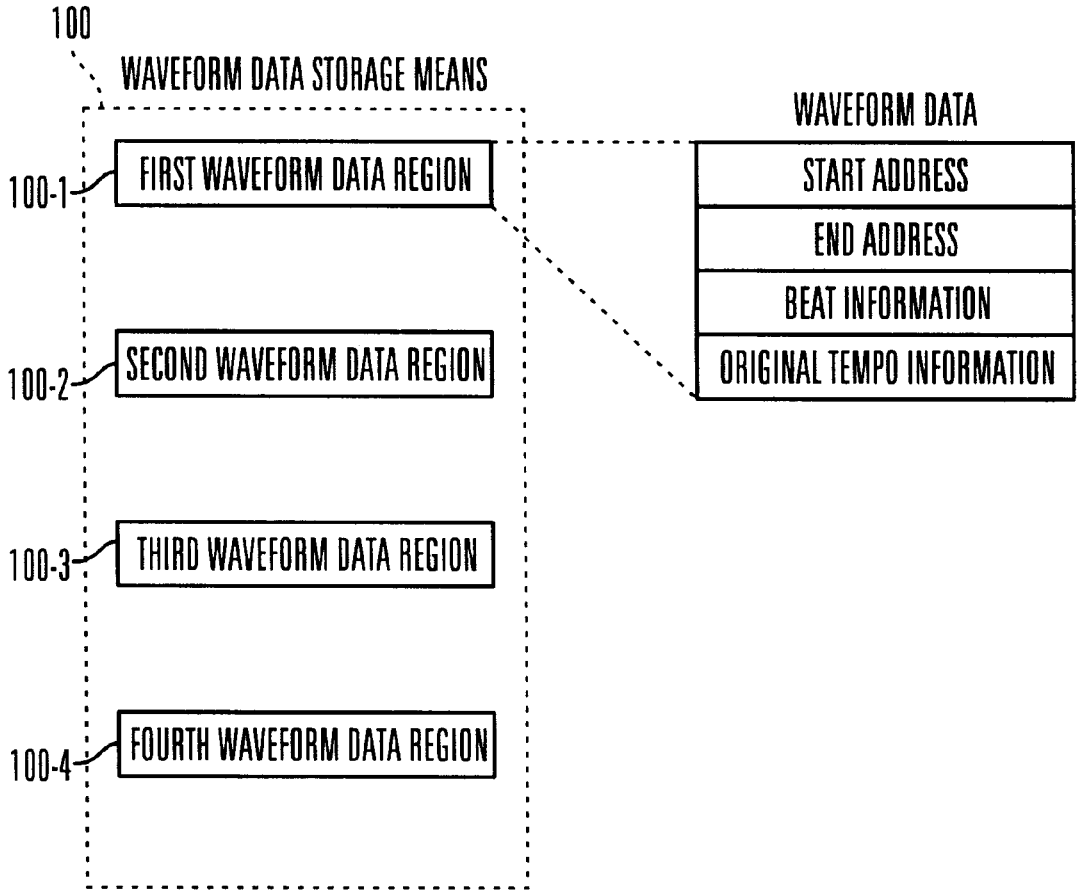
FIG. 3 shows the data configuration of the waveform data stored in the waveform data storage means.

As shown in the block diagram of FIG. 2, the DSP 12 constitutes a means for processing the rendition control of waveform data, but the program for the DSP 12 is stored in the ROM 14, and is loaded into the DSP 12 through the CPU 10. The digital waveform signals, which have been processed for rendition control with the DSP 12, are converted into analog waveform signals with the D/A converter 24, and given out as output.

FIG. 2 is a block diagram of a processing means for executing the rendition control procedure that the DSP 12 realizes as software. This processing means includes a waveform data storage means 100 for storing waveform data, a waveform generation means 102 for compressing or expanding waveform data on the time axis and reproducing the waveform data, a reproduction tempo information production means 104 for producing reproduction tempo information, a control signal production means 106 for producing control signals, modulating the reproduction tempo information produced by the reproduction tempo information production means 104 periodically with the passage of time, and an adding means 108 for adding the signals given out by the waveform generation means 102 and outputting them to the D/A 24.

The waveform data storage means 100 made up by the waveform RAM 18 includes, in an example embodiment, a first waveform data region 100-1, a second waveform data region 100-2, a third waveform data region 100-3, and a fourth waveform data region 100-4 for storing waveform data. In alternative embodiments, however, any number of waveform data regions may be employed. The first to fourth waveform data regions 100-1 to 100-4 store waveform data with the same measure (e.g., four-quarter measure) and the same length (i.e., number of bars), but corresponding to different musical tracks. They also store original tempo information indicating the tempo of the original waveform data.

The waveform data regions include a start address, which is the address to begin the readout, an end address, which is the address to end the read-out, beat information indicating the beat, and original tempo information indicating the original tempo. Also within the waveform data storage means 100 is the waveform data. In preferred embodiments, the waveform data is pulse code modulated (PCM).

In this first embodiment, the beat information is set to either "1" or "0", and it is assumed that the PCM waveform data referenced in the first to fourth data regions 100-1 to 1004 are all set to the same beat information.

For the waveform data stored in the first to fourth data regions 100-1 to 100-4, PCM waveform data generated by sampling a phrase with a sampler can be used for example.

Figure 4:
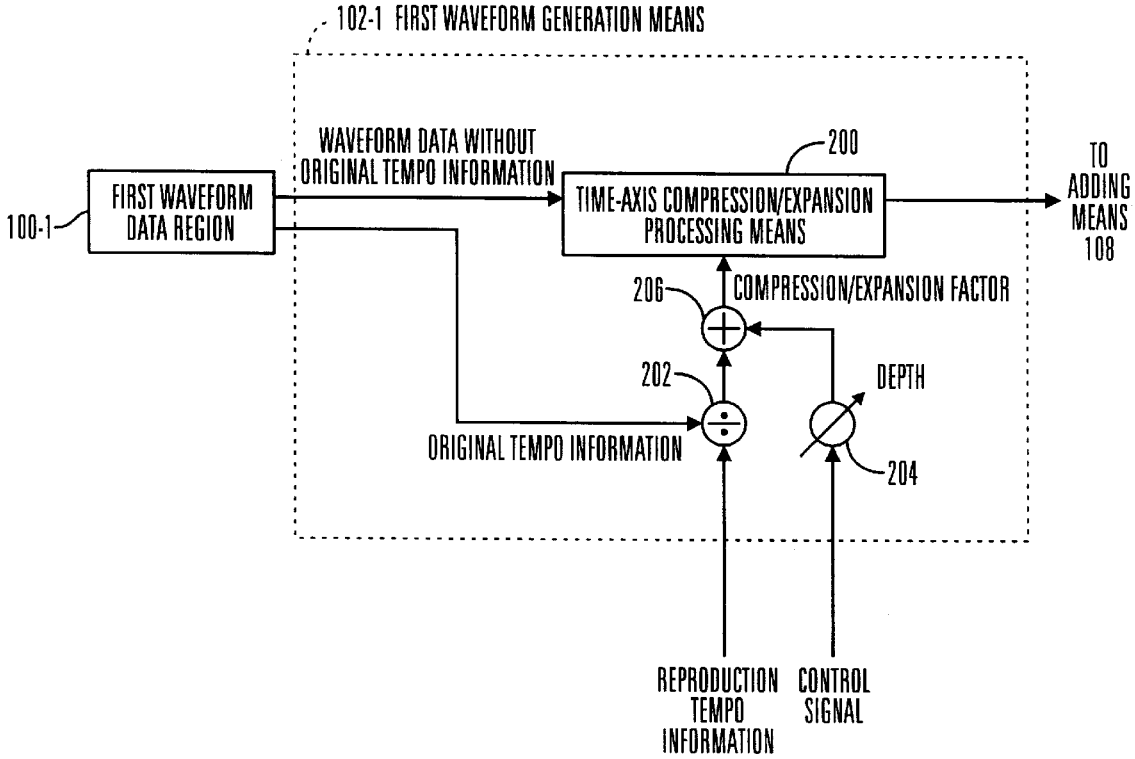
FIG. 4 is a block diagram of the first waveform generation means.

The waveform generation means 102 in the present example includes a first waveform generation means 102-1, a second waveform generation means 102-2, a third waveform generation means 102-3, and a fourth waveform generation means 102-4, corresponding to the first to fourth data regions 100-1 to 100-4, respectively. The first to fourth waveform generation means 102-1 to 102-4 are configured as shown in FIG. 4. (FIG. 4 shows the configuration of only the first waveform generation means 102-1, but the second to fourth waveform generation means 102-2 to 102-4 have the same configuration as the first waveform generation means 102-1.) In accordance with the reproduction tempo information and the control signals that are input, the first to fourth waveform generation means 102-1 to 102-4 waveform compress or expand the waveform data stored in the waveform data storage means 100 (in FIG. 4, this is the first waveform data region 100-1) on the time axis to perform reproduction.

The reproduction tempo is set with a reproduction tempo setting actuator (not shown in the drawings), which is part of the actuator group 20, and the reproduction tempo information production means 104 produces and gives out the reproduction tempo information in correspondence to the set reproduction tempo. The reproduction tempo can be set with the reproduction tempo setting actuator, for example, to 120 BPM (beats per minute).

Instead of setting the reproduction tempo information production means 104 to a reproduction tempo with the reproduction tempo setting actuator to produce and give out reproduction tempo information as explained above, in alternative embodiments it is also possible to enter reproduction tempo information with an external device, such as a keyboard 50, through the MIDI interface 26, or to measure the cycles of a MIDI clock and take them for the reproduction tempo information.

Figure 5:
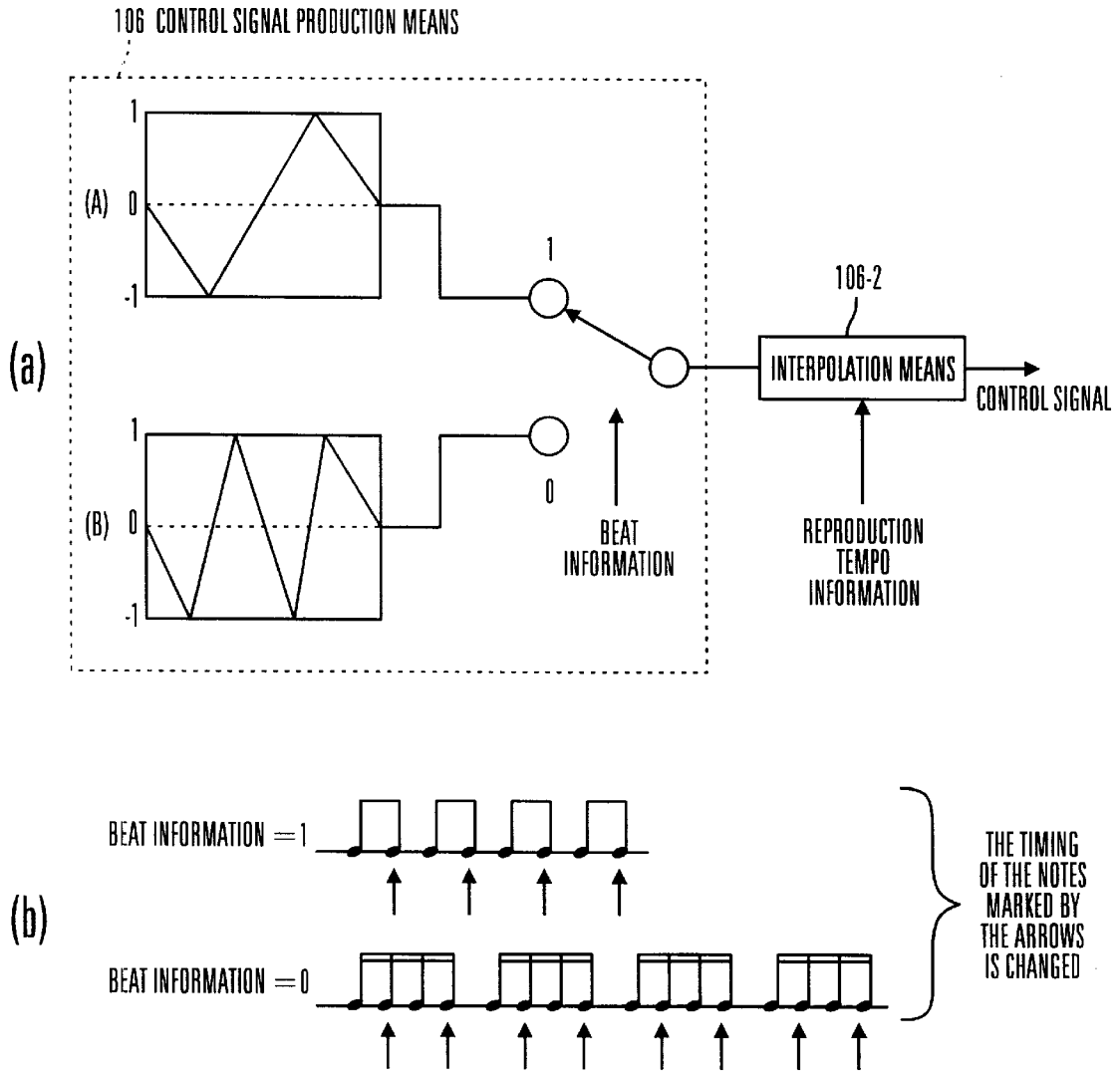
FIG. 5(*a*) is a block diagram of the control signal production means.

The control signal production means 106 is configured as shown in FIG. 5(*a*), and produces a control signal, which is a periodic signal controlling the waveform generation means 102.

The following is a more detailed explanation of the configuration of the first waveform generation means 102-1 with reference to the block diagram of FIG. 4. The first waveform generation means 102-1 includes a time-axis compression/expansion processing means 200, a dividing means 202, a depth multiplication means 204, and an adding means 206.

The time-axis compression/expansion processing means 200 compresses or expands the waveform data stored in the first waveform data region 100-1 on the time axis in accordance with the compression/expansion factor explained below and reproduces them. (The time-axis compression/expansion processing means 200 of the second waveform generation means 102-2 compresses or expands the waveform data stored in the second waveform data region 100-2 on the time axis in accordance with the compression/expansion factor and reproduces them; the time-axis compression/expansion processing means 200 of the third waveform generation means 102-3 compresses or expands the waveform data stored in the third waveform data region 100-3 on the time axis in accordance with the compression/expansion factor and reproduces them; and the time-axis compression/expansion processing means 200 of the fourth waveform generation means 102-4 compresses or expands the waveform data stored in the fourth waveform data region 100-4 on the time axis in accordance with the compression/expansion factor and reproduces them. This is the same in the following.)

The dividing means 202 performs the division output=reproduction tempo information/original tempo information and gives out the result of this calculation to the adding means 206.

The depth multiplication means 204, on the other hand, performs the calculation of multiplying the control signal by a constant factor, and setting the depth (magnitude) of the timing variations. The result of this calculation is given out to the adding means 206. When the result of the calculation performed by the depth multiplication means (i.e., the output to the adding means 206) is a positive value, it corresponds to slowing down, whereas a negative value corresponds to speeding up. The larger the absolute values, the larger the timing variations.

Then, the adding means 206 performs the calculation of adding the output of the dividing means 202 to the output of the depth multiplication means 204, and the result of this calculation is given out to the time-axis compression/expansion processing means 200 as the compression/expansion factor.

If the compression/expansion factor is "1", the time-axis compression/expansion processing means 200 reproduces the waveform data without compressing or expanding them on the time axis. It follows that, in this case, the reproduction tempo is the reproduction tempo of the original indicated by the original tempo information.

If the compression/expansion factor is larger than "1", the time-axis compression/expansion processing means 200 reproduces the waveform data after compressing them on the time axis. It follows that, in this case, the reproduction tempo is faster than the reproduction tempo of the original indicated by the original tempo information.

Conversely, if the compression/expansion factor is smaller than "1", the time-axis compression/expansion processing means 200 reproduces the waveform data after expanding them on the time axis. It follows that, in this case, the reproduction tempo is slower than the reproduction tempo of the original indicated by the original tempo information.

The following is a more detailed explanation of the configuration of the control signal production means 106 with reference to the block diagram of FIG. 5. The control signal production means 106 includes a waveform table 106-1 and an interpolation means 106-2.

The waveform table stores periodic signals, indicated in this first embodiment as the two periodic signals (A) and (B).

The periodic signals (A) and (B) shown are merely easy-to-understand examples, and any periodic signal whose integral is "0" can be used for these periodic signals.

If in this first embodiment a "1" has been stored as the beat information of the waveform data, the periodic signal (A) of the waveform table 106-1 is selected, and the position of eighth notes is changed. On the other hand, if a "0" has been stored as the beat information of the waveform data, the periodic signal (B) of the waveform table 106-1 is selected, and the position of sixteenth notes is changed (see FIG. 5(*b*)).

Instead of using beat information pre-stored in the waveform data as explained above, it is also possible to set the beat information for selecting the control signal stored in the waveform table 106-1 with a resolution setting actuator (not shown in the drawings) part of the actuator group 20. For example, to move the position of eighth notes, it is possible to set "beat information=1" with the resolution setting actuator, and to move the position of sixteenth notes, it is possible to set "beat information =0" with the resolution setting actuator.

Then, depending on the beat information, the interpolation means 106-2 repeatedly reads out the periodic signal from the waveform table 106-1 with the address increment depending on the reproduction tempo information to generate and give out the control signal.

Because there is no waveform data with addresses with a decimal point (i.e., non-integer addresses), in this case an interpolation is performed based on the next higher or lower integer address to generate the control signal.

In this first embodiment, the waveform table stores periodic signals of 120 BPM, and if the reproduction tempo information is 120 BPM, the address increment becomes "1", and if the reproduction tempo information is 60 BPM, the address increment becomes "0.5".

In other words, the address increment is calculated as $$\text{address increment} = \text{reproduction tempo information}/120.$$

In this configuration, the waveform data stored in the first waveform data region 100-1, the second waveform data region 100-2, the third waveform data region 100-3, and the fourth waveform data region 100-4 of the waveform data storage means 100 are compressed or expanded on the time axis and reproduced by the first waveform generation means 102-1, the second waveform generation means 102-2, the third waveform generation means 102-3, and the fourth waveform generation means 102-4, respectively, and given out to the adding means 108. Then, the adding means 108 adds the waveform data that have been compressed or expanded on the time axis by the first waveform generation means 102-1, the second waveform generation means 102-2, the third waveform generation means 102-3, and the fourth waveform generation means 102-4, and the result of the addition is given out to the D/A 24.

The first waveform generation means 102-1, the second waveform generation means 102-2, the third waveform generation means 102-3, and the fourth waveform generation means 102-4, compress or expand the waveform data on the time axis in accordance with the compression/expansion factor, which has been obtained by adding (i) the result of the division of the reproduction tempo information produced in the reproduction tempo information production means 104, divided by the original tempo information, which is performed by the dividing means 202, to (ii) the result of the multiplication of the control signal produced by the control signal production means 106 performed by the depth multiplication means 204.

The interpolation means 106-2 corrects the control signal produced by the control signal production means 106, so that it becomes a periodic signal corresponding to the reproduction tempo information produced by the reproduction tempo information production means 104.

Consequently, in this rendition control apparatus for controlling the rendition of waveform data, control signals are not stored for each set of waveform data, but are produced by the control signal production means 106 so as to have a period corresponding to the reproduction tempo information, so that there is no need for a large memory region for storing control signals.

Also, in this rendition control apparatus for controlling the rendition of waveform data, even when the waveform data stored in the first waveform data region 100-1, the second =waveform data region 100-2, the third waveform data region 100-3, and the fourth waveform data region 100-4 for storing waveform data included in the waveform data storage means 100 is sound-produced simultaneously, it is sufficient if the control signal production means 106 generates only one control signal that has a period corresponding to the reproduction tempo information, and there is no need to generate control signals for every sound produced with the waveform data.

Also, in this rendition control apparatus for controlling the rendition of waveform data, the control signal production means 106 produces a control signal that is periodic corresponding to the reproduction tempo information, so that if the reproduction tempo changes, there is no need to compress or expand the control signal to match the reproduction tempo.

Second Embodiment

The following is an explanation of a rendition control apparatus in accordance with a second embodiment of the present invention.

Figure 6:
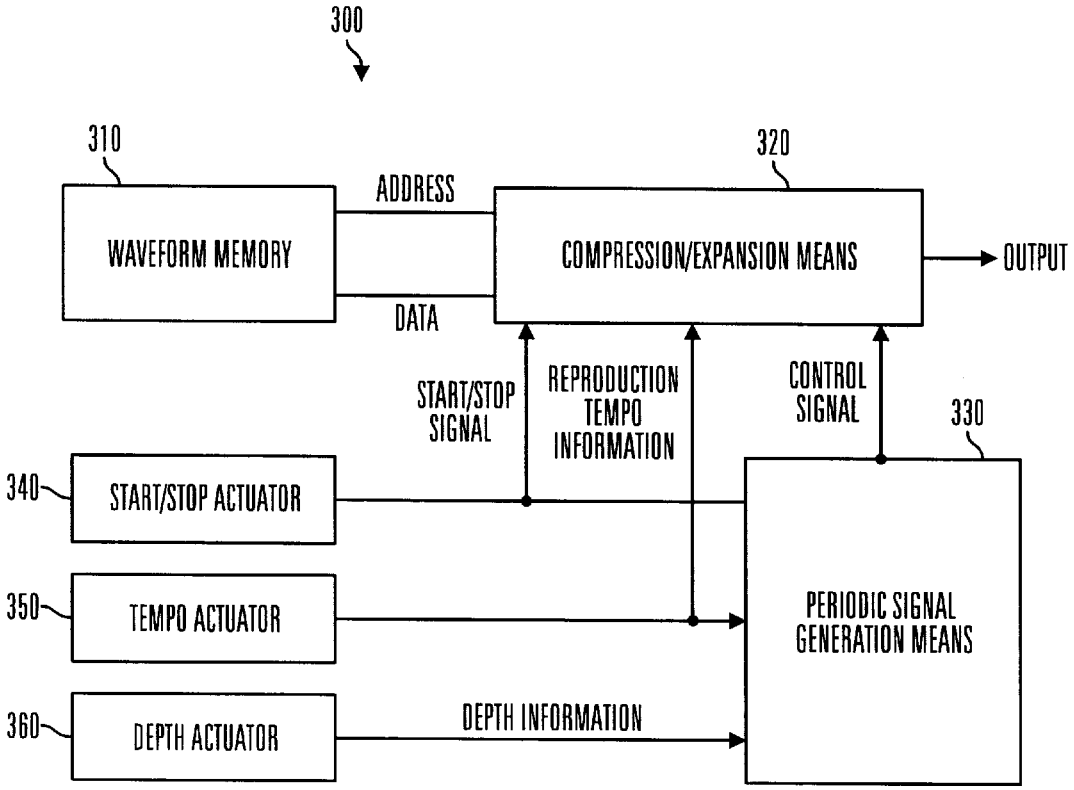
FIG. 6 is a block diagram showing a second embodiment of the rendition control apparatus of the present invention laid out in hardware.

FIG. 6 is a block diagram showing a second embodiment of the rendition control apparatus of the present invention laid out in hardware.

When, e.g., in a swing rendition of a phrase with the rendition control apparatus in FIG. 6, phrase portions with strong stress (i.e., down beats) are rendered, the swing rendition takes into account the down beats, and when phrase portions with weak stress (i.e., up beats) are rendered, the swing rendition takes into account the up beats, resulting in a smoothly textured rendition, with a so-called "good rhythm".

This rendition control apparatus 300 includes a waveform memory 310, a compression/expansion means 320, a periodic signal generation means 330, a start/stop actuator 340, a tempo actuator 350, and a depth actuator 360. First of all, the actuators 340, 350, and 360 will be explained.

The start/stop actuator 340 is for instructing the begin or the end of a rendition of a continuous musical sound. If it is actuated once, it sets the start/stop signal that is given out to the "H" level to indicate the begin of the rendition, and if it is actuated again, it sets the start/stop signal to the "I," level to indicate the end of the rendition.

The tempo actuator 350 corresponds to the reproduction tempo setting means of the present invention. It is for setting the tempo of the reproduction waveform with the compression/expansion means 320 explained below, and outputs reproduction tempo information expressing the tempo that has been set.

The depth actuator 360 is for setting the size of the added swing (i.e., the modulation depth), and outputs depth information expressing the depth of the modulation that has been set.

Figure 7:
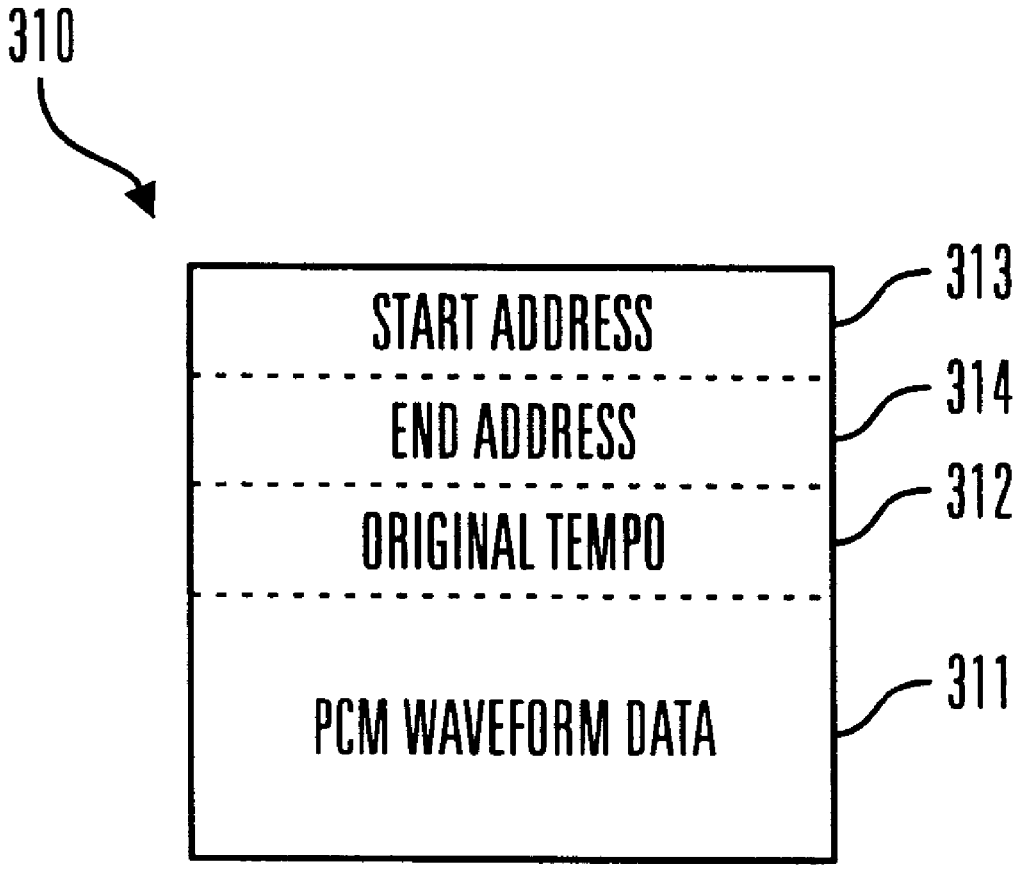
FIG. 7 is a diagram showing the data structure of the waveform memory shown in FIG. 6.

The following is an explanation of the waveform memory 310 with reference to FIG. 7.

FIG. 7 is a diagram showing the data structure of the waveform memory shown in FIG. 6.

This waveform memory 310 corresponds to the waveform storage means of the present invention. The waveform memory 310 includes PCM waveform data 311 as the main waveform data, an original tempo 312 as the initial tempo of this PCM waveform data 311, a start address 313 marking the start of the waveform data 311, and an end address 314 marking the end of the waveform data 311.

The compression/expansion means 320 is explained with reference to FIG. 8.

Figure 8:
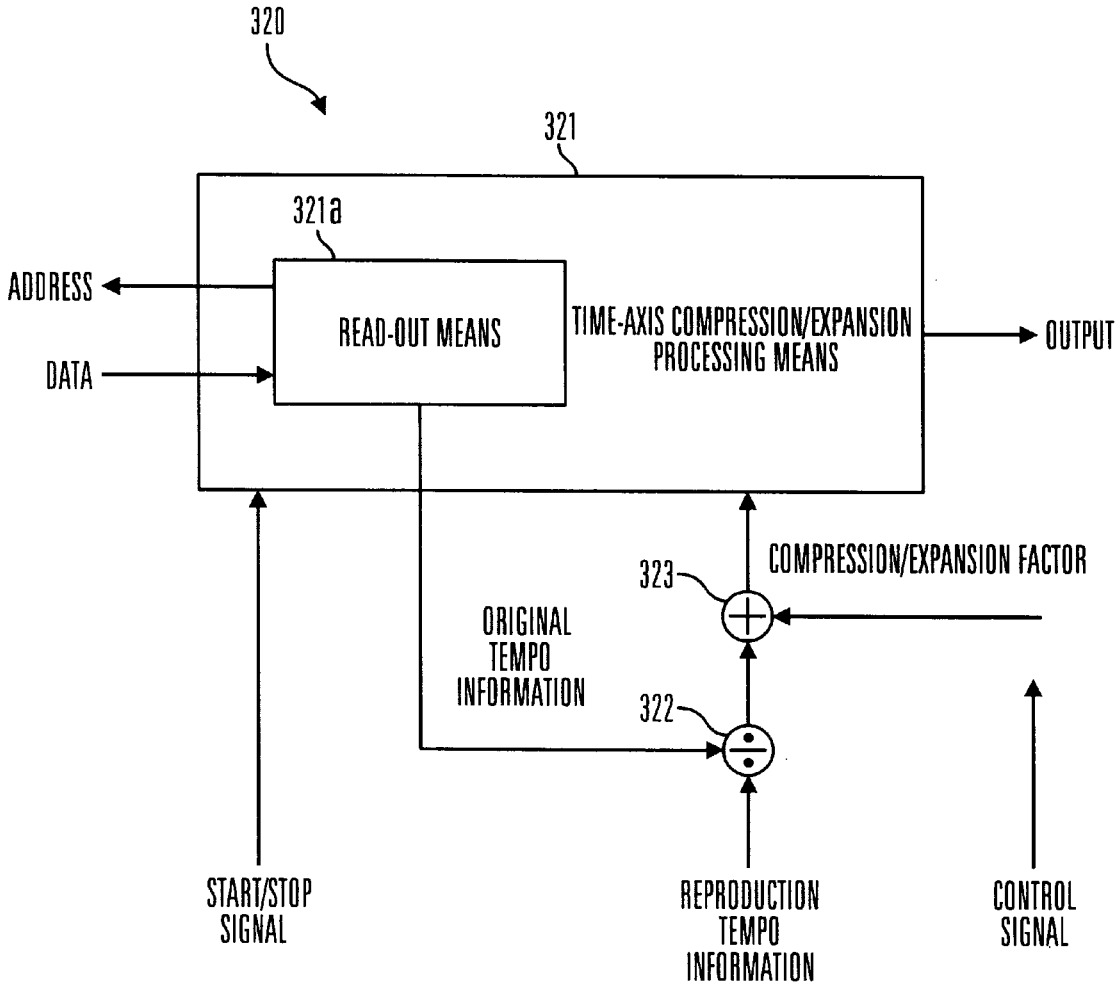
FIG. 8 is a diagram of the internal configuration of the compression/expansion means of FIG. 6 shown in blocks.

FIG. 8 is a diagram of the internal configuration of the compression/expansion means of FIG. 6 shown in blocks.

The compression/expansion means 320 shown in FIG. 8 includes a time-axis compression/expansion processing means 321 including a read-out means 321*a*, a dividing means 322, and an adding means 323.

The time-axis compression/expansion processing means 321 generates a reproduction waveform by expanding or compressing, within periods that have been segmented in accordance with note length, the former half or the latter half, respectively, of the waveform expressed by the PCM waveform data, while following the change of the control signal, which indicates the level of compression or expansion, and whose temporal changes are tolerated as will be explained below. The read-out means 321*a* included in the time-axis compression/expansion processing means 321 outputs into the waveform memory 310 an address for reading out, for example, the PCM waveform data 311 and the original tempo 312 necessary to reproduce the PCM waveform data 311, and based on this address, it reads out, for example, the PCM waveform data 311 and the original tempo 312 necessary to reproduce the PCM waveform data 311 from the waveform memory 310.

The dividing means 322 receives the reproduction tempo information from the tempo actuator 350 and the original tempo information from the read-out means 321*a* as input, and performs the division "reproduction tempo information/original tempo information" to calculate the "reference compression/expansion factor" for performing reproduction at the reproduction tempo in correspondence to the reproduction tempo information. For example, if:

reproduction tempo information=180 BPM original tempo information=100 BPM then reference compression/expansion factor=180/100=1.8

The adding means 323 generates the compression/expansion factor (corresponding to the reproduction signal in the present invention) by adding the level of the control signal to the reference compression/expansion factor determined by the dividing means 322, and inputs it into the time-axis compression/expansion processing means 321.

If a compression/expansion factor larger than "1" is input into the time-axis compression/expansion processing means 321, the time-axis compression/expansion processing means 321 generates a reproduction waveform by compressing the PCM waveform data 311 on the time axis, and the reproduction tempo is sped up. Conversely, if a compression/expansion factor smaller than "1" is input into the time-axis compression/expansion processing means 321, the time-axis compression/expansion processing means 321 generates a reproduction waveform by expanding the PCM waveform data 311 on the time axis, and the reproduction tempo is slowed down. If a compression/expansion factor of "1" is input, there is neither compression nor expansion, so that the reproduction waveform is generated at the original tempo.

Figure 9:
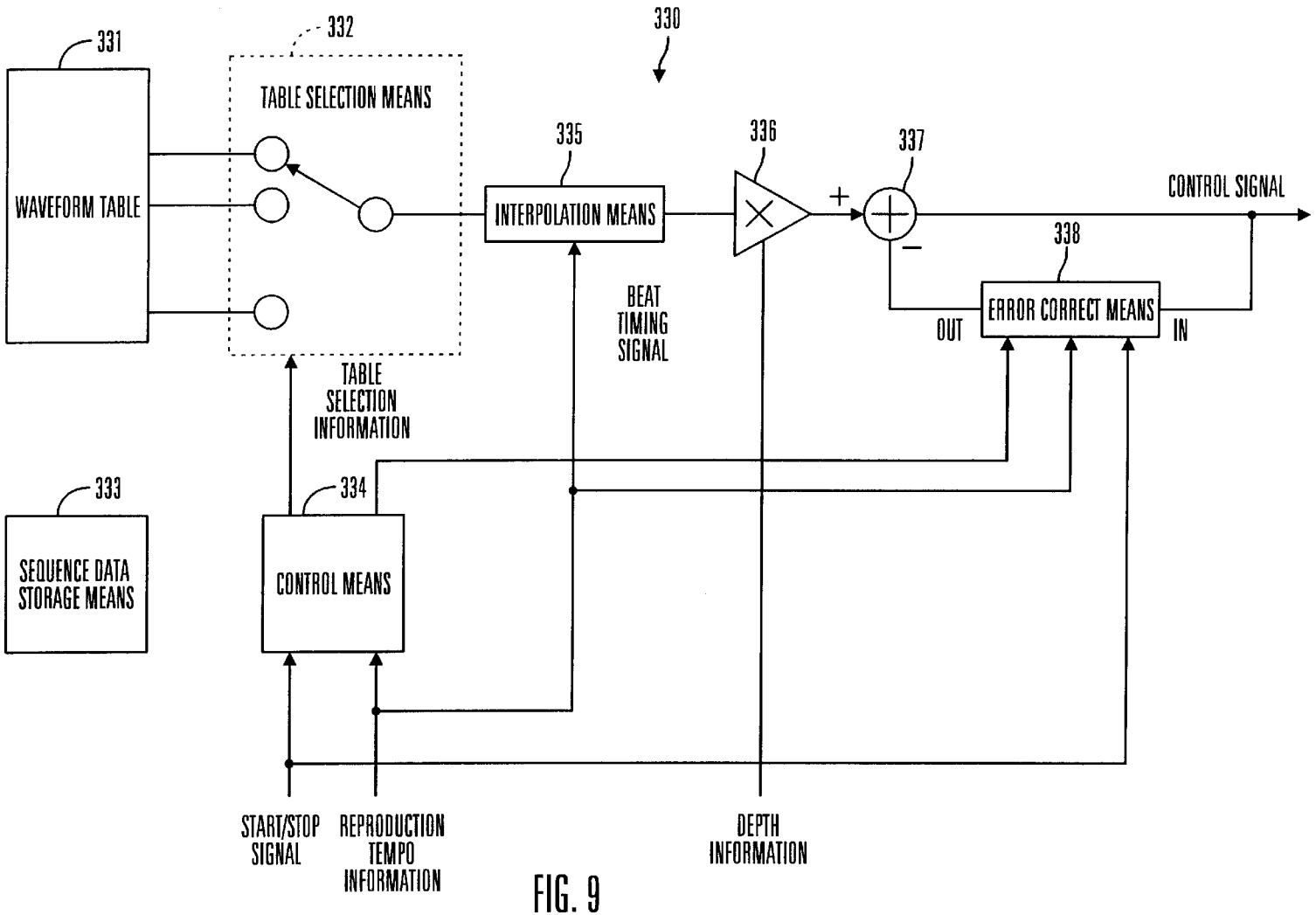
FIG. 9 is a diagram of the internal configuration of the periodic signal generation means of FIG. 6 shown in blocks.

The following is an explanation of the periodic signal generation means 330 with reference to FIG. 9.

FIG. 9 is a diagram of the internal configuration of the periodic signal generation means of FIG. 6 shown in blocks.

The periodic signal generation means 330 in FIG. 9 includes a waveform table 331, a table selection means 332, a sequence data storage means 333, a control means 334, an interpolation means 335, a multiplication means 336, an adding means 337, and an error correction means 338.

Here, the waveform table 331 corresponds to the periodic waveform storage means of the present invention, and the table selection means 332 and the control means 334 correspond to the periodic waveform read-out means of the present invention. The waveform table 331 and the sequence data storage means 333 are explained with reference to FIG. 10 and 11.

Figure 10:
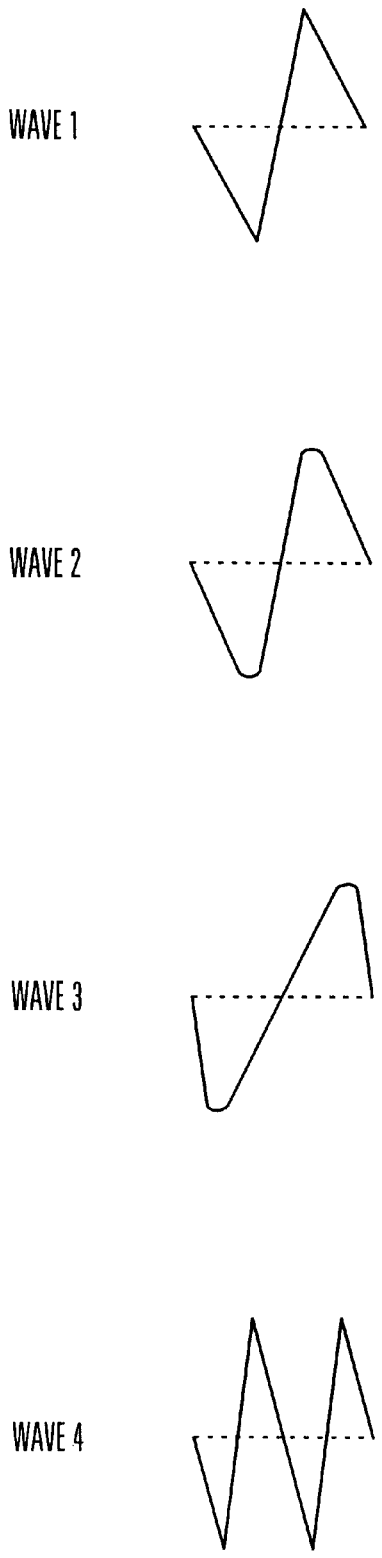
FIG. 10 shows a plurality of periodic waveforms stored in the waveform table.
Figure 11:
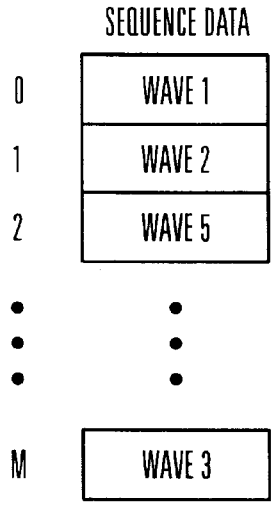
FIG. 11 shows sequence data stored in the sequence data storage means.

FIG. 10 shows a plurality of periodic waveforms stored in the waveform table. It should be noted that in alternative embodiments of the present invention, the periodic waveforms may be calculated in real time rather than stored in memory. FIG. 11 shows sequence data stored in the sequence data storage means.

As shown in FIG. 10, the waveform table 331 stores a plurality of periodic waveforms wave1, wave2, wave3, wave4, . . . with different waveform shapes, taking the periodic signal for one beat as one unit. The sequence data storage means 333 stores the sequence data specifying the order with which the plurality of periodic waveforms wave1, wave2, wave3, wave4, . . . are read out, as shown in FIG. 11. In FIG. 11, they are read out in the order wave 1, wave2, wave 5, . . . , wave 3.

The start/stop signal and the reproduction tempo information are entered into the control means 334 shown in FIG. 9. If the level "H" is entered as the start/stop signal into the control means 334, the control means 334 looks up the sequence data stored in the sequence data storage means 333, and outputs a table selection information corresponding to the looked up sequence data into the table selection means 332. Based on this table selection information, the table selection means 332 selects a periodic waveform from the waveform table 331, in accordance with the sequence data. Thus, a periodic signal expressing the selected periodic waveform (referred to as the "first periodic signal" in the following) is entered into the interpolation means 335. Moreover, the control means 334 generates a beat timing signal in correspondence with the reproduction tempo information input, and inputs it into the error correction means 338 explained below.

The interpolation means 335 receives the reproduction tempo information, in addition to the aforementioned first periodic signal. The interpolation means 335 generates an interpolated periodic signal by reading out the first periodic signal waveform with the address increment, which depends on the reproduction tempo information, performing an interpolation calculation, and compressing or expanding the first periodic signal waveform on the time axis in accordance with the reproduction tempo information. It should be noted that the interpolation means 335 is drawn to be independent from the above-mentioned periodic waveform read-out means, but in reality the two have overlapping portions.

When the waveform table 331 is read out with the address increment corresponding to the reproduction tempo information, the read-out address sometimes becomes an address with a decimal point, and there are no waveform data present. Therefore, the waveform data are read out at the next higher or lower integer address, and then waveform data with a decimal point address are generated by an interpolation calculation.

This method is often used for sound sources of electronic instruments of the waveform reading type, and is well known in the art.

Here, the waveform table 331 stores periodic waveforms of 120 BPM. The address increment is calculated as address increment=reproduction tempo information/120.

For example, if the reproduction tempo information is 120 BPM, the address increment becomes "1", so that the period of the interpolated periodic signal is the same as the period of the first periodic signal. And if the reproduction tempo information is 60 BPM, the address increment becomes "0.5", so that the period of the interpolated periodic signal is expanded to twice the period of the first periodic signal.

The interpolated periodic signal generated by the interpolation means 335 is entered into the multiplication means 336. Also depth information from the depth actuator 360 is entered into the multiplication means 336. The multiplication means 336 multiplies the interpolated periodic signal with a depth factor based on the depth information, and sets the level of the interpolated periodic signal, i.e., the depth of the modulation. Thus, it is possible to set the size of the timing change of the swing. In this manner, the signal period is changed with the interpolation means 335, and its level is changed with the multiplication means 336 to generate a second periodic signal. This second periodic signal is entered into the error correction means 338, after it has passed the adding means 337.

Figure 12:
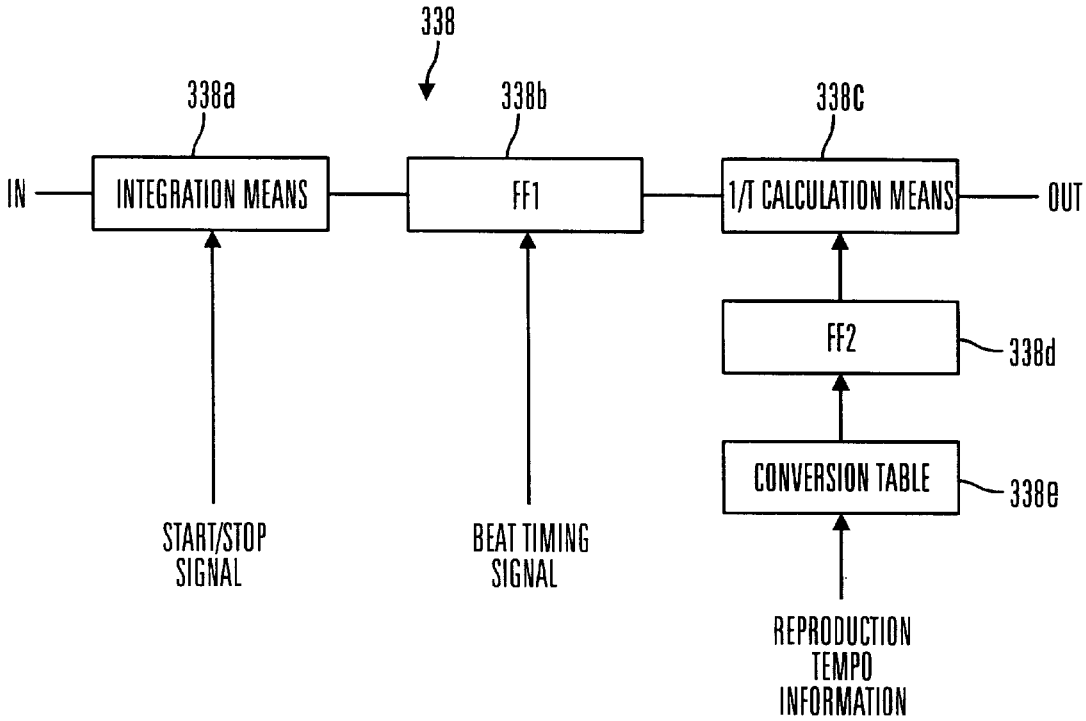
FIG. 12 is a diagram of the internal structure of the error correction means of FIG. 9 shown in blocks.
Figure 13:
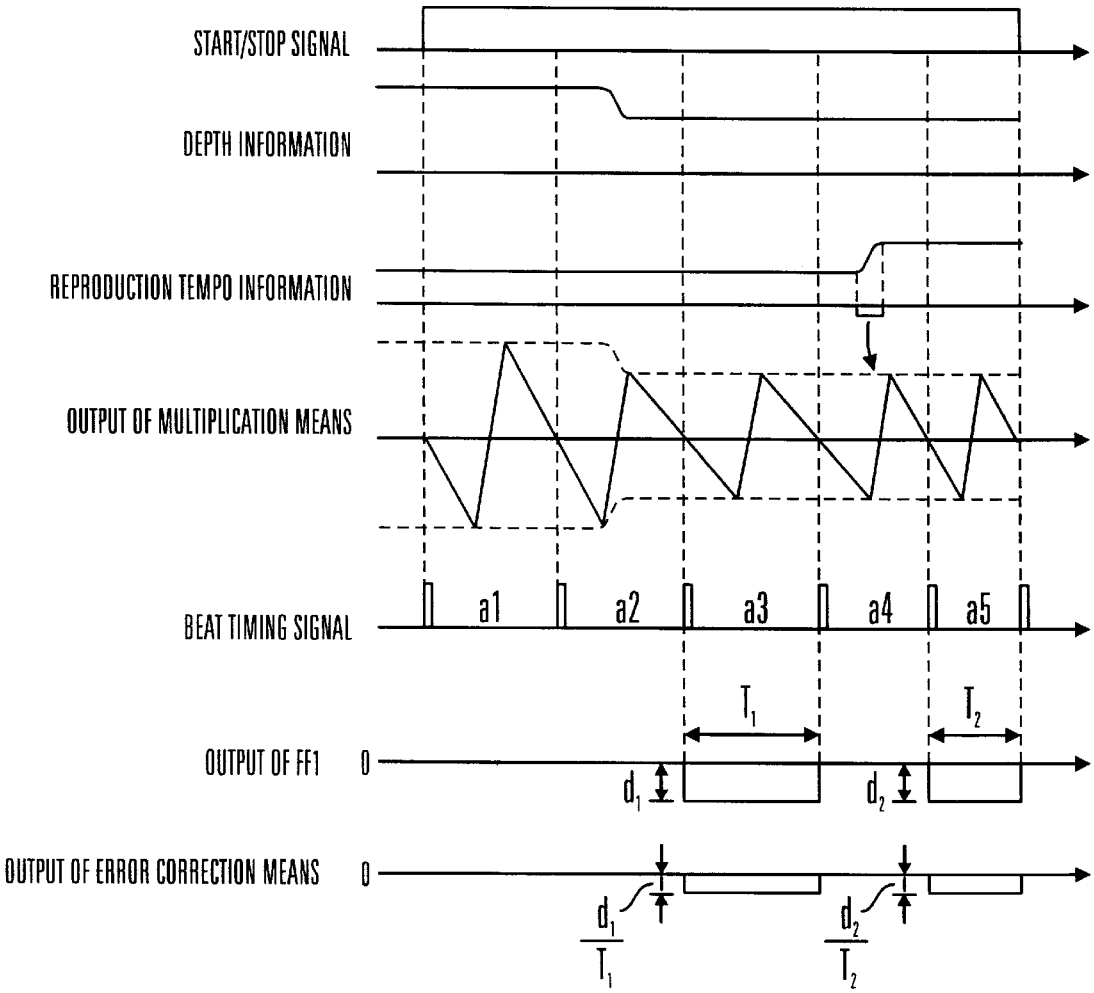
FIG. 13 is a diagram showing operation waveforms of the rendition control apparatus in FIG. 6.

The error correction means 338 generates the control signal by correcting the second periodic signal with the adding means 337 so that the error of the amount of compression or expansion converges toward zero, when the second periodic signal is transferred as the control signal to the compression/expansion means 320 (see FIG. 6). Referring to FIG. 12 and 13, the following explains how the error correction means 338 converges the error of the amount of compression or expansion toward zero.

FIG. 12 is a block diagram showing the internal structure of the error correction means shown in FIG. 9. FIG. 13 is a diagram showing operation waveforms of the rendition control apparatus in FIG. 6.

The error correction means 338 shown in FIG. 12 includes an integration means 338*a*, a flip-flop 338*b* (FF1), a 1/T calculation means 338*c*, a flip-flop 338*d* (FF2), and a conversion table 338*e*. As shown in FIG. 6, the depth actuator 360 and the tempo actuator 350, which are included in the rendition control apparatus 300, give out depth information and reproduction tempo information of a certain level. In this situation, the start/stop actuator 340 is actuated and the start/stop signal that is given out is set to the "H" level. This causes the control means 334 to operate (see FIG. 9), and a second periodic signal depending on the depth information and the reproduction tempo information is given out from the multiplication means 336. After passing the adding means 337, this second periodic signal is entered into the integration means 338*a* as a signal IN. The integration means 338*a* integrates the waveform of the second periodic signal. In the first segment a1, marked by the beat timing signal shown in FIG. 13, the area of the expanding first half (i.e., the area on the minus side) of the waveform expressed by the second periodic signal is equal to the area of the compressing latter half (i.e., the area on the plus side), so that the integral for this segment is zero. During the following segment a2, the depth actuator 360 is actuated and the modulation is set to be flatter. Thus, the area of the plus side becomes smaller than the area of the minus side, and the integration means 338*a* outputs an integration value of the difference between these areas. At the beat timing signal, this integration value is sampled by the flip-flop 338*b*, which gives out an error signal with an area of level d1×period T1. This error signal is given into the 1/T calculation means 338*c*. On the other hand, data for obtaining a period based on the reproduction tempo information are given into the flip-flop 338*d* from the conversion table 338*e*. At the beat timing signal, the flip-flop 338*d* samples these data to obtain the period T1, which it gives into the 1/T calculation means 338*c*. The 1/T calculation means 338*c* divides the error signal from the flip-flop 338*b* by the period T1, and feeds back the division d1/T1 as the signal OUT to the adding means 337. Thus, the area of the minus side and the area of the plus side of the waveform of the second periodic signal in the segment a3 become equal, and the error signal is cancelled.

Then, during segment a4, the tempo actuator 350 is actuated to set a higher tempo. This causes the reproduction tempo to go up, and the period of the second periodic signal becomes shorter in accordance with this level. Thus, the area of the plus side becomes smaller than the area of the minus side of the waveform of the second periodic signal in the segment a4, and in the following segment a5, the value d2/T2 obtained similarly as explained for the segment a3 is fed back to the adding means 337 as the signal OUT, so that the error signal is cancelled.

Figure 14:
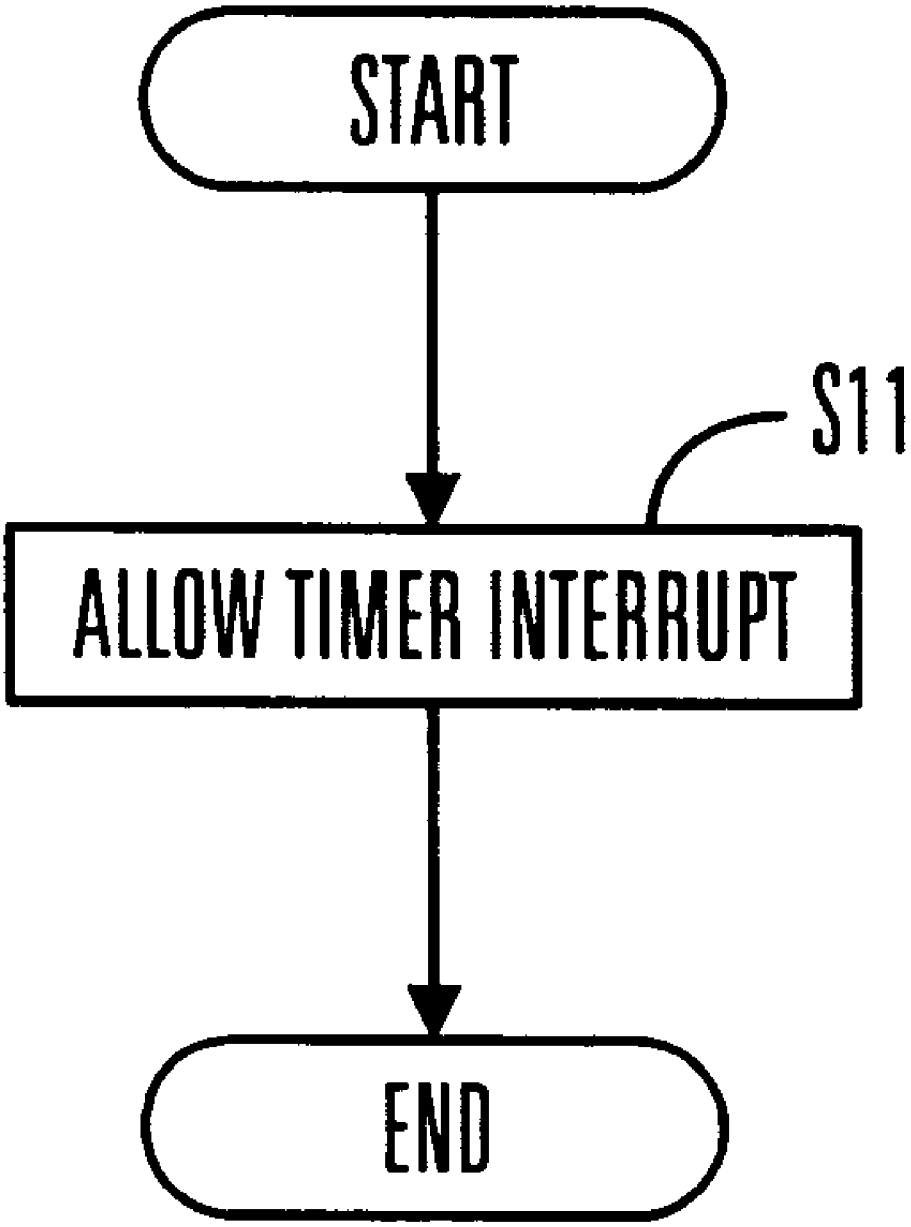
FIG. 14 is a flowchart of the start processing routine performed by the control means shown in FIG. 9.

FIG. 14 is a flowchart of the start processing routine performed by the control means shown in FIG. 9.

The start processing routine is started by an interrupt signal produced when actuating the start/stop actuator 340 for starting the rendition to change the start/stop signal from the "L" level to the "H" level. In step S11 of this start processing routine, the routine is ended by permitting a timer interrupt of a timer (not shown in the drawings), which is included in the control means 334. When the timer interrupt is permitted, the timer produces a timer interrupt signal at certain intervals. In the following, this is explained with reference to FIG. 15.

Figure 15:
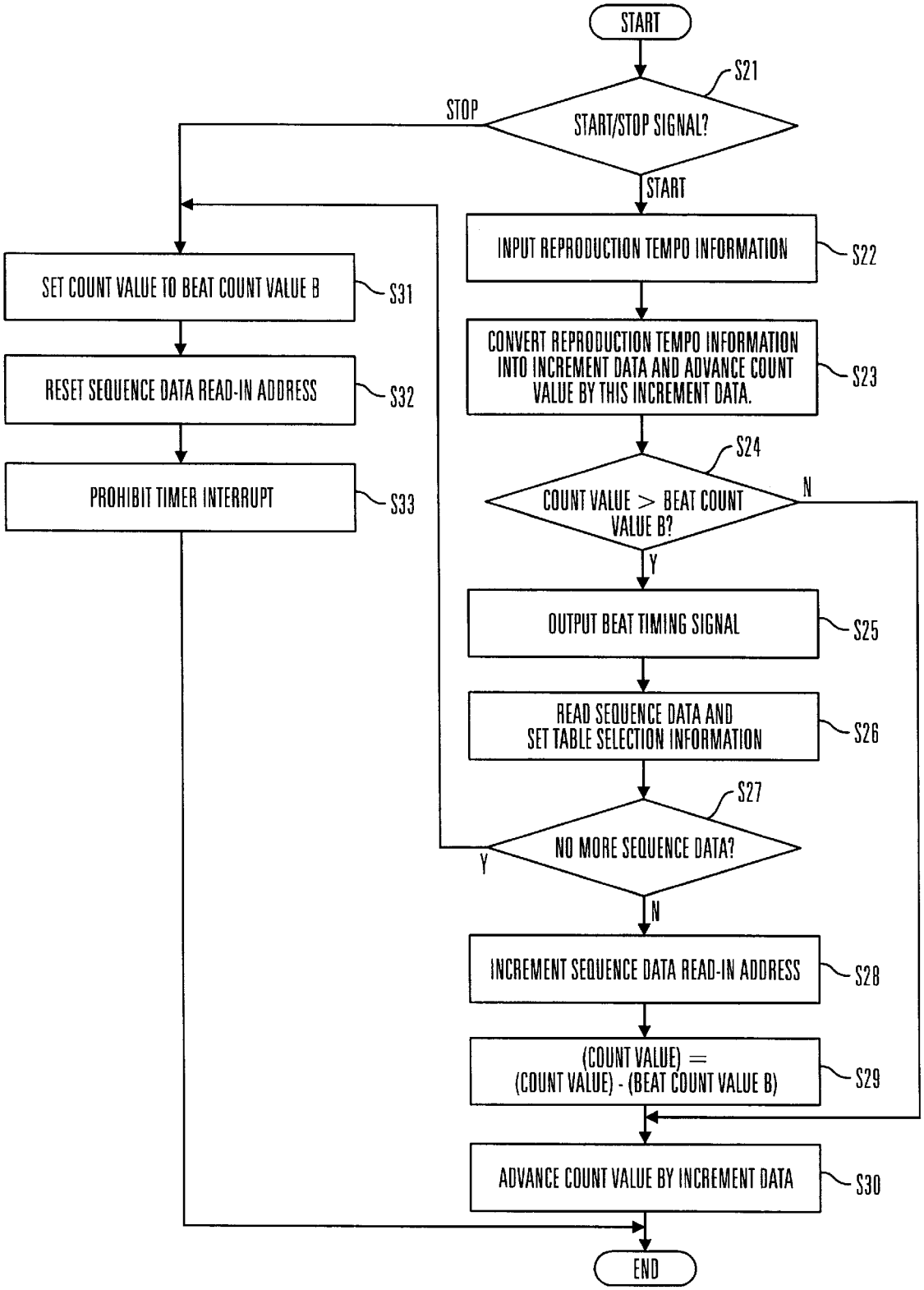
FIG. 15 is a flowchart of the timer interrupt processing routine performed by the control means shown in FIG. 9.

FIG. 15 is a flowchart of the timer interrupt processing routine performed by the control means shown in FIG. 9.

When the timer interrupt is permitted at the previously mentioned step S11 shown in FIG. 14, this routine is repeated at certain intervals, depending on the timer interrupt signal from the timer in the control means 334.

First of all, in step S21, it is determined whether the start/stop signal is on the "H" level or on the "L" level. If it is determined that it is on the "H" level, the begin of a rendition is indicated, so that the procedure advances to step S22. At step S22, the reproduction tempo information is entered, then the procedure advances to step S23. At step S23, the reproduction tempo information is converted into increment data, and the count value of a counter is advanced by this increment data.

In the following step S24, it is determined whether the count value of the counter is equal to or larger than the beat count value B. Here, the beat count value B indicates the B that is the figure to which the counter should count during one beat. If it is determined that the count value is smaller than the beat count value B, the procedure advances to step S30 explained below, because the time for one beat has not yet passed. On the other hand, if it is determined that the count value is equal to or larger than the beat count value B, the time for one beat has passed, and the procedure advances to step S25. Step S25 gives out the beat timing signal, whose period depends on the reproduction tempo information.

At the following step S26, sequence data are read in from the sequence data storage means, and the table selection information is set. Then, the procedure advances to step S27. Step S27 determines whether the sequence data are terminated or not. If it has been determined that the sequence data are terminated, the rendition is finished, and the procedure advances to step S31 explained below. If it has been determined that the sequence data are not finished, the rendition continues, and the procedure advances to step S28. At step S28, the sequence data read-in address is incremented, and the procedure advances to step S29. At step S29, the new count value is set to the count value minus the beat count value B. This is done to correct the error that occurs when the count value has been incremented to exceed the beat count value B. At step S30, the count value is advanced by the increment data, and the routine is terminated.

On the other hand, if step S21 determines that the start/stop signal is on the "L" level, the presently executed rendition is stopped, and the procedure advances to step S31.

At step S31, the count value is set to the beat count value B. This makes it possible to precisely output the beat timing signal at the next rendition start. At the next step S32, the sequence data read-in address is reset, and the procedure advances to step S33. At step S33, the timer interrupt is prohibited, and the routine is terminated.

As has been explained above, the rendition control apparatus 300 of this second embodiment generates, with the periodic signal generation means 330 shown in FIG. 6, a periodic signal whose waveform shape changes with the passage of time, transfers this periodic signal to the compression/expansion means 320 as a control signal, and generates a reproduction waveform by compressing or expanding a sound waveform stored in the waveform memory 310 with the compression/expansion means 320 while following the change of this control signal. Therefore, when, e.g., in a swing rendition of one certain phrase, phrase portions with down beats are rendered, a periodic signal whose waveform is adapted to the down beats is taken as the control signal, and when phrase portions with up beats are rendered, a periodic signal whose waveform is adapted to the up beats is taken as the control signal, so that the rendition differentiates between up beats and down beats. Consequently, a rendition with good rhythm becomes possible.

If, during a swing rendition, the reproduction tempo information or the depth information is changed with the tempo actuator 350 or the depth actuator 360, the periodic signal generation means 330 generates the control signal in a manner that the error of the amount of compression or expansion caused by the changed information converges toward zero, so that the swing rendition can be changed immediately.

This second embodiment includes a tempo actuator 330, which is actuated to obtain reproduction tempo information expressing a certain tempo. However, the present invention is not limited to this configuration, and it is also possible to obtain the reproduction tempo information through a MIDI interface, or to measure the cycles of a MIDI clock and take them for the reproduction tempo information.

Also, this second embodiment has been explained taking a swing rendition as an example, but the present invention is not limited to this, and can be equally applied to a shuffle or other kinds of renditions.

Furthermore, in this second embodiment, only a configuration has been explained in which the waveform shape controlling the compression or expansion on the time axis changes with the passage of time, but if, in addition to this, the volume of the reproduction waveform signal is changed over the passage of time, an even more natural rendition can be obtained in combination with the compression and expansion on the time axis in accordance with the present invention.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description. All changes that come within the meaning and range of equivalency of the claims are intended to be embraced therein.

What is claimed is:

1. A system for rendition control, the system comprising:

a waveform storage means for storing a continuous sound waveform;

a compression and expansion means for generating a reproduction waveform by compressing or expanding the sound waveform while following a temporally changing control signal indicating a level of compression or expansion; and a periodic signal generation means for generating a periodic signal whose waveform shape changes with the passage of time;

wherein the periodic signal is communicated to the compression and expansion means as the control signal; and wherein the periodic signal generation means comprises:

a periodic waveform storage means for storing a plurality of periodic waveforms;

a periodic waveform read-out means for temporally switching, in accordance with certain sequence information, between the plurality of periodic waveforms so as to generate a periodic signal whose waveform shape changes with the passage of time; and a sequence information storage means for storing sequence information specifying an order with which the periodic waveforms are read out by the periodic waveform read-out means.

2. The system as recited in claim 1, further including:

a reproduction tempo setting means for setting a tempo of the reproduction waveform in said compression and expansion means;

wherein the compression and expansion means generates a reproduction waveform having a tempo set with the reproduction tempo setting means; and wherein the periodic signal generation means generates a periodic signal whose period corresponds to the tempo set with the reproduction tempo setting means.

3. A system for rendition control, the system comprising:

memory for storing a plurality of sets of waveform data rendered at a certain tempo;

a processor programmed for producing reproduction tempo information indicating a reproduction tempo, producing a periodic control signal with a period that corresponds to the reproduction tempo information for modulating the waveform data, and compressing or expanding and reproducing the plurality of sets of waveform data in real-time based on the reproduction tempo information and the control signal; and an adder for adding the compressed or expanded plurality of sets of waveform data.

4. A system as recited in claim 3, further including an input port for receiving the reproduction tempo information from an external device.

5. A system as recited in claim 3, the memory further including:

a start and end address for locating each set of waveform data in the memory;

beat information for indicating the beat of each set of waveform data; and original tempo information for indicating an original tempo of each set of waveform data.

6. A system as recited in claim 5, the processor further programmed for:

dividing the reproduction tempo information by the original tempo information to produce a reproduction tempo ratio;

multiplying the control signal by a constant factor to produce a timing variation depth value;

adding the reproduction tempo ratio to the timing variation depth value to produce a compression/expression factor; and compressing or expanding and reproducing the plurality of sets of waveform data in real-time based on the compression/expression factor.

7. A system as recited in claim 5:

the memory for storing a plurality of periodic signals having a particular tempo, each periodic signal having a integral of zero; and the processor further programmed for utilizing the beat information to select one periodic signal from the plurality of periodic signals;

computing an address increment value as the reproduction tempo information divided by the particular tempo of the stored plurality of periodic signals, and reading out the selected periodic signal from the memory at address locations interpolated from the address increment value to produce the control signal.

8. A system for rendition control, the system comprising:

memory for storing waveform data rendered at a certain tempo; and a processor programmed for producing reproduction tempo information indicating a reproduction tempo, producing depth information indicating a modulation depth, producing a periodic control signal with a period that corresponds to the reproduction tempo information and an amplitude that corresponds to the modulation depth for modulating the waveform data, and compressing or expanding and reproducing the waveform data in real-time based on the reproduction tempo information and the control signal.

9. A system as recited in claim 8, the memory comprising:

the waveform data;

a start and end address for locating the waveform data in the memory; and original tempo information for indicating an original tempo of the waveform data.

10. A system as recited in claim 9, the processor further programmed for:

dividing the reproduction tempo information by the original tempo information to produce a reproduction tempo ratio;

adding the reproduction tempo ratio to the control signal to produce a compression/expression factor; and compressing or expanding and reproducing the waveform data in real-time based on the compression/expression factor.

11. A system as recited in claim 9:

the memory for storing a plurality of periodic signals having a particular tempo, each periodic signal having a integral of zero, and a plurality of sets of sequence data, each set of sequence data for determining an order for reading out the plurality of periodic signals; and the processor further programmed for reading out a sequence of periodic signals from the memory based on the sequence data at the reproduction tempo, computing an address increment value as the reproduction tempo information divided by the particular tempo of the stored plurality of periodic signals, interpolating and compressing or expanding the sequence of periodic signals using the address increment value to produce a first intermediate control signal, multiplying the first intermediate control signal with the depth information to produce a second intermediate control signal, and error-correcting the second intermediate control signal with a beat timing signal and the reproduction tempo information to produce the control signal with a compression or expansion error that converges toward zero.

12. A system as recited in claim 11, the processor further programmed for error-correcting the second intermediate control signal by:

integrating the control signal;

sampling the integrated control signal with the beat timing signal to produce an error signal;

converting the reproduction tempo information to a period value;

sampling the period value with the beat timing signal to produce a reproduction period;

dividing the error signal by the reproduction period to produce an error correction output; and adding the error correction output to the second intermediate control signal to produce the control signal.

13. A method for rendition control, the method comprising the steps of:

storing waveform data rendered at a certain tempo;

producing reproduction tempo information indicating a reproduction tempo;

producing a periodic control signal with a period that corresponds to the reproduction tempo information for modulating the waveform data; and compressing or expanding and reproducing the waveform data in real-time based on the reproduction tempo information and the control signal.

14. A method as recited in claim 13, the method further including the steps of:

storing a plurality of sets of waveform data rendered at a certain tempo;

compressing or expanding and reproducing the plurality of sets of waveform data in real-time based on the reproduction tempo information and the control signal; and adding the compressed or expanded plurality of sets of waveform data.

15. A method as recited in claim 14, the step of storing a plurality of sets of waveform data comprising the steps of:

storing a start and end address for locating each set of waveform data in the memory;

storing beat information for indicating the beat of each set of waveform data; and storing original tempo information for indicating an original tempo of each set of waveform data.

16. A method as recited in claim 13, further including the step of receiving the reproduction tempo information from an external device.

17. A method as recited in claim 15, further including the steps of:

dividing the reproduction tempo information by the original tempo information to produce a reproduction tempo ratio;

multiplying the control signal by a constant factor to produce a timing variation depth value;

adding the reproduction tempo ratio to the timing variation depth value to produce a compression/expression factor; and compressing or expanding and reproducing the plurality of sets of waveform data in real-time based on the compression/expression factor.

18. A method as recited in claim 15, further including the steps of:

storing a plurality of periodic signals having a particular tempo, each periodic signal having a integral of zero;

utilizing the beat information to select one periodic signal from the plurality of periodic signals;

computing an address increment value as the reproduction tempo information divided by the particular tempo of the stored plurality of periodic signals; and reading out the selected periodic signal from the memory at address locations interpolated from the address increment value to produce the control signal.

19. A method for rendition control, the method comprising the steps of:

storing waveform data rendered at a certain tempo;

producing reproduction tempo information indicating a reproduction tempo;

producing depth information indicating a modulation depth;

producing a periodic control signal with a period that corresponds to the reproduction tempo information and an amplitude that corresponds to the modulation depth for modulating the waveform data; and compressing or expanding and reproducing the waveform data in real-time based on the reproduction tempo information and the control signal.

20. A method as recited in claim 19, the step of storing waveform data comprising the steps of:

storing the waveform data;

storing a start and end address for locating the waveform data in the memory; and storing original tempo information for indicating an original tempo of the waveform data.

21. A method as recited in claim 20, further including the steps of:

dividing the reproduction tempo information by the original tempo information to produce a reproduction tempo ratio;

adding the reproduction tempo ratio to the control signal to produce a compression/expression factor; and compressing or expanding and reproducing the waveform data in real-time based on the compression/expression factor.

22. A method as recited in claim 20, further including the steps of:

storing a plurality of periodic signals having a particular tempo, each periodic signal having a integral of zero;

storing a plurality of sets of sequence data, each set of sequence data for determining an order for reading out the plurality of periodic signals;

reading out a sequence of periodic signals from the memory based on the sequence data at the reproduction tempo;

computing an address increment value as the reproduction tempo information divided by the particular tempo of the stored plurality of periodic signals;

interpolating and compressing or expanding the sequence of periodic signals using the address increment value to produce a first intermediate control signal;

multiplying the first intermediate control signal with the depth information to produce a second intermediate control signal; and error-correcting the second intermediate control signal with a beat timing signal and the reproduction tempo information to produce the control signal with a compression or expansion error that converges toward zero.

23. A method as recited in claim 22, the step of error-correcting the second intermediate control signal comprising the steps of:

integrating the control signal;

sampling the integrated control signal with the beat timing signal to produce an error signal;

converting the reproduction tempo information to a period value;

sampling the period value with the beat timing signal to produce a reproduction period;

dividing the error signal by the reproduction period to produce an error correction output; and adding the error correction output to the second intermediate control signal to produce the control signal.

* * * * *